United States Patent [19]

Schonstedt

[11] Patent Number: 4,839,624

[45] Date of Patent: Jun. 13, 1989

[54] MAGNETIC CORES

[75] Inventor: Erick O. Schonstedt, Reston, Va.

[73] Assignee: Schonstedt Instrument Company, Reston, Va.

[21] Appl. No.: 154,094

[22] Filed: Feb. 9, 1988

Related U.S. Application Data

[62] Division of Ser. No. 891,995, Aug. 1, 1986, Pat. No. 4,803,773.

[51] Int. Cl.[4] ..... H01F 27/24

[52] U.S. Cl. ..... 336/213; 324/260; 336/233; 428/542.8

[58] Field of Search ..... 242/7-11; 336/213, 233, 234, 221; 29/418, 557, 558, 6.1, 6.2; 428/542.8; 338/206; 324/260

[56] References Cited

U.S. PATENT DOCUMENTS

| | | | |
|---|---|---|---|
| 1,195,221 | 8/1966 | Herr | 29/6.1 |
| 2,290,486 | 7/1942 | Ballard et al. | 29/6.1 |
| 2,498,674 | 2/1950 | Graham et al. | 242/7.11 X |
| 2,981,885 | 4/1961 | Schonstedt | 336/213 X |
| 3,206,536 | 9/1965 | Goodloe | 29/6.1 X |
| 4,089,090 | 5/1978 | Westberg | 29/6.1 |

*Primary Examiner*—Thomas J. Kozma

*Attorney, Agent, or Firm*—Shapiro and Shapiro

[57] ABSTRACT

Magnetic cores are manufactured from preforms of magnetically permeable strip material wrapped about non-magnetic supports. The preforms have configurations, such as an X-configuration, that determine the placement and helix angle of convolutions of the strip material that constitute the cores. In a preferred embodiment, corresponding ends of the legs of an X-configuration preform are placed upon a support, and the preform is wrapped about the support so as to form two superposed layers of convolutions, with the convolutions of corresponding portions of the layers having opposite helix angles.

11 Claims, 1 Drawing Sheet

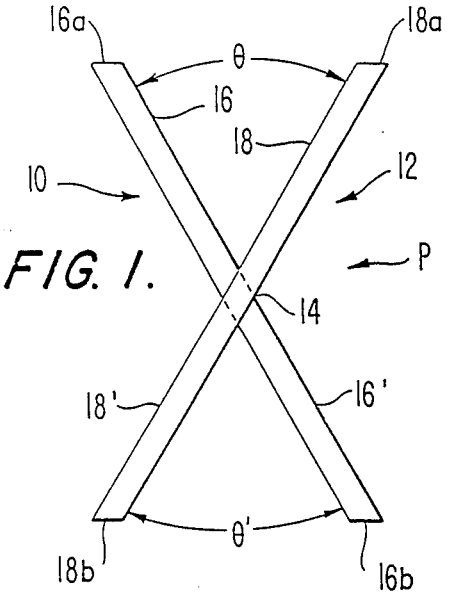
FIG. 1.
FIG. 2.
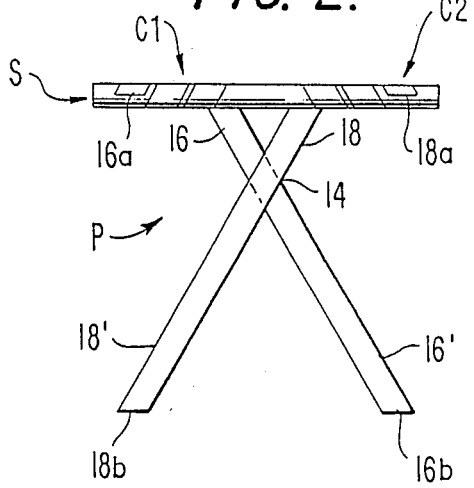
FIG. 3.
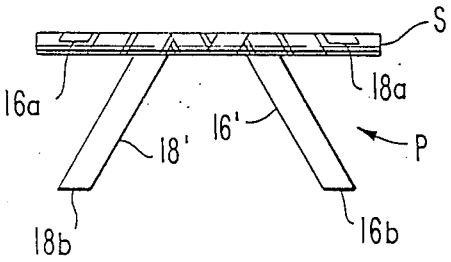
FIG. 4.
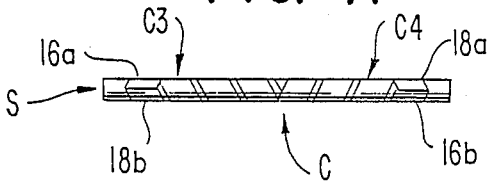
FIG. 5.
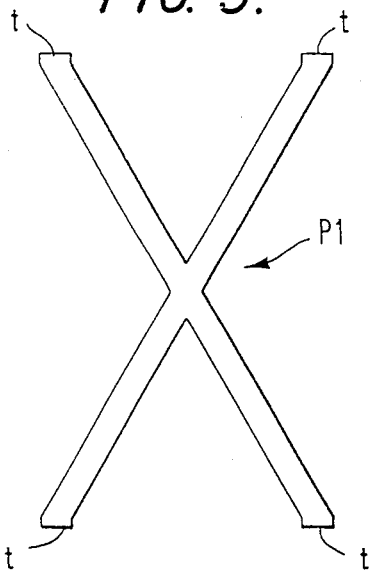
FIG. 6.
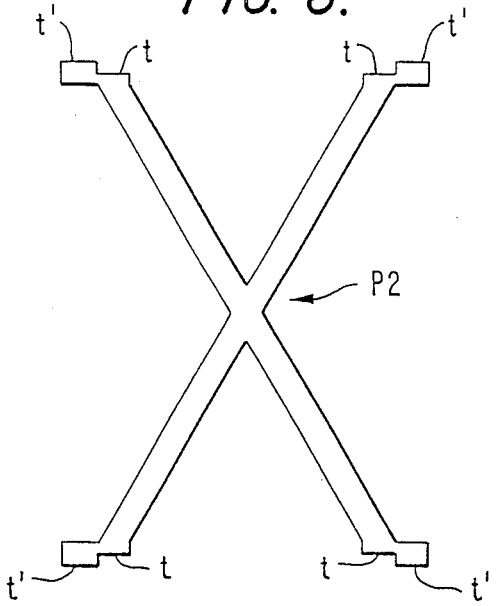

MAGNETIC CORES

This application is a divisional of U.S. Ser. No. 891,995, now U.S. Pat. No. 4,803,773, filed Aug. 1, 1986.

BACKGROUND OF THE INVENTION

This invention relates to magnetic cores, and more particularly to simple magnetic cores formed of magnetically permeable strip material.

Saturable measuring devices, such as fluxgate magnetometers or gradiometers, require saturable cores. My prior U.S. Pat. No. 2,916,696, issued Dec. 8, 1959, discloses saturable measuring devices having magnetic cores formed by helically winding magnetically permeable wire, for example. In my prior U.S. Pat. No. 2,981,885, issued Apr. 25, 1961, disclosed an improved type of magnetic core employing superposed oppositely wound coaxial coils of magnetically permeable strip material interwoven on a non-magnetic support. While this type of magnetic core is highly advantageous in many respects, such as the avoidance of permanent magnetization, manufacture of this type of core requires a high degree of skill in order to interweave the strips uniformly. In my prior U.S. Pat. No. 3,168,696, issued Feb. 2, 1965, I disclosed a further improvement in which a hollow cylinder of magnetically permeable material has a special configuration intended to provide the advantages of the interwoven strip type core, but without requiring th same degree of manufacturing skill. Nevertheless, the need has remained for an even simpler type of magnetic core having most, if not all, of the advantages of the interwoven core. The present invention is directed to the achievement of that goal.

BRIEF DESCRIPTION OF THE INVENTION

In one of its broader aspects, the invention is a method of making a magnetic core, that comprises wrapping about an elongated support at least one piece of magnetically permeable material constituted by elongated elements, the arrangement of the elements being such that as the material is wrapped about the support the elements form simultaneously two sets of convolutions on the support with different helix angles.

In another of its broader aspects, the invention is a magnetic core comprising an elongated support having thereon a layer formed from a single piece of magnetically permeable material, the piece being wrapped about the support and defining at a first region of the support a first set of helical convolutions and at a second region of the support a second set of helical convolutions, the convolutions of said first set having a helix angle in one direction and the convolutions of the second set having a helix angle in the opposite direction.

In yet another of its broader aspects, the invention is a magnetic core perform comprising a single piece of magnetically permeable material having a pair of elongated elements that converge from a pair of end regions to a central region.

The invention will be further described in conjunction with the accompanying drawings, which illustrate preferred (best mode) embodiments.

BRIEF DESCRIPTION OF THE DRAWINGS

FIG. 1 is a plan view showing, in accordance with the invention, an X-configuration preform of magnetically permeable strip material;

FIG. 2, 3, and 4 are plan views illustrating a method of winding the preform of FIG. 1 upon a mandrel or support to form a magnetic core (shown completed in FIG. 4); and FIGS. 5 and 6 are views similar to FIG. 1, but illustrating modifications of the invention.

DETAILED DESCRIPTION OF THE INVENTION

U.S. Pat. No. 2,981,885, referred to earlier and now incorporated herein by reference, discloses magnetic cores formed of interwoven helically wound magnetically permeable strip material, such as "Permalloy." In accordance with the present invention, the same type of material can be used to form magnetic cores that resemble the interwoven cores both structurally and functionally but that do not require the interweaving of strip material. Remarkably, cores with performance approaching that of interwoven cores can be produced by simple wrapping of strip material, preferably as a preform, about a mandrel or support.

In a simple embodiment of the invention shown in FIG. 1, two strips 10 and 12 of magnetically permeable material are formed into a X-configuration preform P. Although cores in accordance with the invention can be produced by winding separate strips, it is preferred to use a preform, which in the embodiment of FIG. 1 is produced by forming a joint at the central cross-over area 14 of the strips, as by cementing or welding. The resultant X-shaped preform P comprises strip elements 16, 16' and 18, 18' forming the legs of the X-configuration. Elements 16 and 18 converge toward the central region 14 from a first pair of spaced end regions **16*a*, 18*a*, and elements 16', 18' diverge from the central region 14 to a further pair of spaced end regions 16*b*, 18*b***.

To form a magnetic core from the preform P of FIG. 1, the end regions **16*a*, 18*a* are placed upon corresponding longitudinally spaced areas of an elongated mandrel or support S (FIG. 2), preferably a cylindrical tube of non-magnetic material. The end regions 16*a*, 18*a* may be attached to the support by cementing, for example. The preform may be disposed horizontally with the central region 14 spaced from the support and with the end regions 16*b*, 18*b* farthest from the support. If the support S is now turned about is longitudinal axis so as to wrap the preform P upon its outer surface, successive convolutions of the magnetically permeable strip material will be formed on the support as shown in FIG. 2. To provide the desired conformity of the convolutions with the support, the preform P may be dragged across a horizontal surface with some friction, or resistance to the wrapping of the preform may be provided by anchoring the end regions 16*b*, 18*b* temporarily, so that the support S moves toward the end regions 16*b*, 18*b*** during the winding operation.

It is apparent in FIG. 2 that as the preform is wrapped about the support a first layer of convolutions is formed upon the support, the first layer being constituted by a first set of helical convolutions C1 and by a second set of helical convolutions C2 substantially covering successive longitudinal areas of the support. It will also be apparent in FIG. 2 that set C1 has a helix angle in one direction and set C2 has a helix angle in the opposite direction. As the wrapping operation continues, the central region 14 of the preform moves toward and then onto the support. Further wrapping causes portions 16', 18' of the preform to be wrapped upon the support as shown in FIG. 3 and to form a second layer of convolutions superposed upon the first layer. As is apparent in FIG. 4, the second layer is constituted by a third set of helical convolutions C3 and a fourth set of helical convolutions C4. Set C3 is superposed upon set C1, but with the helix angle of set C2, and set C4 is superposed upon set C2, but with the helix angle of set C1. As each layer is formed, two sets of convolutions are formed simultaneously, with the convolutions of the two sets being wound progressively toward a central area of the support or progressively away from the central area. Upon the completion of the wrapping operation, the end region 18*b* may be secured to the end region 16*a*, and the end region 16*b* may be secured to the end region 18*a*, as by cementing or welding, for example. The completed magnetic core C appears as shown in FIG. 4. Since the second layer of convolutions is formed upon the first layer, it is preferred that portions 16′, 18′ by slightly longer than corresponding portions 16, 18 so as to accommodate the larger diameter of the second layer. The angle $\theta'$ between elements 16′ and 18′ should be slightly less than the angle $\theta$ between elements 16 and 18, so that the end regions 16*b*, 18*b* will meet the end regions 18*a*, 16*a*, respectively, of the wound core. The thinner the strip material, the less the difference between the diameters of the layers. The strip elements may have a thickness of $\frac{1}{4}$ mil or $\frac{1}{2}$ mil (which is perpendicular to the support) and may have a width of 3/16 inch, for example. If the support S is to form the permanent support for the wound strip material, rather than merely a temporary mandrel, the ends of the strips are preferably permanently attached to the support, as by cementing or welding. By using initially softened Permalloy, subsequent heat treatment of the Permalloy (as disclosed in U.S. Pat. No. 2,981,885, for example) can be eliminated for some applications.

By virtue of the invention, simple magnetic cores are provided with performance approaching that of interwoven cores. Yet, no painstaking interweaving of convolutions is required.

FIGS. 5 and 6 illustrate modifications of preforms in accordance with the invention. Each of these preforms, P1 and P2, is formed from a single piece of material. The preforms may, for example, be stamped out of a sheet of Permalloy or may be separated from a sheet of Permalloy by a chemical milling operation. In the embodiment shown in FIG. 5, small tabs t have been added to the ends of the legs of the X-configuration. The tabs at the top of the X-configuration can be overlapped with the tabs at the bottom of the X-configuration when the winding is completed, and cemented or welded thereto, for example, to hold the core together. In the embodiment of FIG. 6, outrigger tabs t′ have been added, in addition to the tabs t. Tabs t′ at the top of the X-configuration can be cemented to the support initially and after winding they can be cemented to the corresponding tabs at the bottom of the preform. Then the tabs t at the top of the preform can be welded to the tabs t at the bottom, and the tabs t′ cut off if desired.

While preferred embodiments of the invention have been shown and described, it will be apparent to those skilled in the art that further modifications can be made without departing from the principles and the spirit of the invention as set forth in the following claims. For example, a chain of X-shaped preforms, with the X's arranged in a series extending away from the support, may be used to provide more than two layers of convolutions, while if the X's are arranged in a series extending along a longer support, longer cores or successive core sections may be produced. If the elements 16′, 18′ are severed from the corresponding elements 16, 18 in FIG. 1, so as to form two angle sections, these separate sections may be wrapped about a support successively to provide a core structure like that shown in FIG. 4. For some purposes, even wrapping of a single angle section about the support may produce a useful core, although clearly not one having the characteristics of an interwoven core. Other preform shapes may also be used for appropriate applications. Thus, the legs of the X-shaped preform may be curved (outwardly or inwardly), rather than straight. Two semi-circles, for example, joined back-to-back at a central region would provide such an X-shaped preform. The vertex or central region of an angle-shaped preform may be placed upon the support at the beginning of the winding operation, rather than the ends of the legs. Extrapolating this concept, a diamond-shaped preform, or even a circular or oval preform, might also be used for certain applications. Again, however, many such preforms would not produce the highly desirable uniform and uniformly spaced convolutions of the preforms shown in the drawings that closely simulate an interwoven core.

The invention claimed is:

1. A magnetic core comprising an elongated nonmagnetic support having at least two superposed layers of magnetically permeable material thereon, one of said layers being constituted by a first set of helical convolutions with a helix angle in one direction followed longitudinally by a second set of helical convolutions with a helix angle in the opposite direction, and another of said layers being constituted by a third set of helical convolutions superposed upon the first set but with a helix angle in said opposite direction and a fourth set of helical convolutions superposed upon said second set but with a helix angle in said one direction.

2. A magnetic core in accordance with claim 1, wherein said support is a tube.

3. A magnetic core comprising an elongated support having thereon an arrangement of at least one piece of magnetically permeable material constituted by elongated elements wrapped about the support so that the elements form simultaneously two sets of convolutions on the support with different helix angles, wherein said elements are strips arranged in a configuration that diverges from a central region to spaced end regions of said elements, and wherein said central region is placed upon a corresponding area of said support with said end regions remote from said support and said convolutions are simultaneously formed progressively away from said area in opposite directions.

4. A magnetic core comprising an elongated support having thereon an arrangement of at least one piece of magnetically permeable material constituted by elongated elements wrapped about the support so that the elements form simultaneously two sets of convolutions on the support with different helix angles, wherein said elements are strips arranged in a configuration that converges from one pair of spaced end regions to a central region and then diverges from said central region to another pair of spaced end regions, and wherein said end regions of one of said pairs are placed upon said support initially at corresponding longitudinally spaced areas of said support and said convolutions are simultaneously formed progressively toward a central area between said spaced areas, and said central region is then placed upon the support and said convolutions are thereafter simultaneously formed progressively away from said central area until the end regions of the other of said pairs are placed upon said support.

5. A magnetic core in accordance with claim 4, wherein said elements are formed into an X-configuration, with said end regions being the ends of legs of said X-configuration.

6. A magnetic core in accordance with claim 5, wherein the length of the elements constituting portions of said legs extending from said central region to said other pair of end regions is greater than the length of the elements constituting portions of said legs extending from said one pair of end regions to said central region, and the angle between the first-mentioned portions is less than the angle between the second-mentioned portions.

7. A magnetic core in accordance with claim 4, wherein said end regions of said legs are formed with tabs.

8. A magnetic core in accordance with claim 7, wherein one pair of said tabs is attached to said support initially.

9. A magnetic core in accordance with claim 7, wherein one pair of said tabs is attached to another pair of said tabs to retain the core.

10. A magnetic core comprising an elongated support and a layer of magnetically premeable material constituted by two elongated strip elements wrapped about the support directly on the support and arranged so that the elements from two sets, respectively, of successive convolutions, all of the convolutions of one set having a first helix angle and being formed directly on the support at a first area of the support and all of the convolutions of the other set have a second helix angle opposite to the first helix angle and being formed directly on the support at a second area of the support longitudinally spaced from the first area, each of said strip elements having a thickness that is substantially less than its width and that is perpendicular to said support.

11. A magnetic core in accordance with claim 10, further comprising a second layer of magnetically permeable material constituted by elongated strip elements wrapped about the support and arranged to form two sets of convolutions upon the first-mentioned sets, respectively, with helix angles opposite to the helix angles of the first-mentioned sets, respectively.

* * * * *